US007886538B2

(12) United States Patent
Schöttler et al.

(10) Patent No.: US 7,886,538 B2
(45) Date of Patent: Feb. 15, 2011

(54) METHOD FOR OPERATING A STEAM POWER PLANT, PARTICULARLY A STEAM POWER PLANT IN A POWER PLANT FOR GENERATING AT LEAST ELECTRICAL ENERGY, AND CORRESPONDING STEAM POWER PLANT

(75) Inventors: Michael Schöttler, Erlangen (DE); Anja Wallmann, Erlangen (DE); Rainer Wulff, Pommelsbrunn (DE)

(73) Assignee: Siemens Aktiengesellschaft, Munich (DE)

( * ) Notice: Subject to any disclaimer, the term of this patent is extended or adjusted under 35 U.S.C. 154(b) by 931 days.

(21) Appl. No.: 11/791,798

(22) PCT Filed: Nov. 16, 2005

(86) PCT No.: PCT/EP2005/056008

§ 371 (c)(1),
(2), (4) Date: May 29, 2007

(87) PCT Pub. No.: WO2006/058845

PCT Pub. Date: Jun. 8, 2006

(65) Prior Publication Data

US 2008/0104959 A1 May 8, 2008

(30) Foreign Application Priority Data

Nov. 30, 2004 (EP) ..... 04028295

(51) Int. Cl.
*F01K 7/34* (2006.01)
*F01K 7/22* (2006.01)

(52) U.S. Cl. ..... 60/653; 60/680

(58) Field of Classification Search ..... 60/653, 60/679–680

See application file for complete search history.

(56) References Cited

U.S. PATENT DOCUMENTS

| | | | | |
|---|---|---|---|---|
| 3,277,651 | A * | 10/1966 | Augsburger | 60/657 |
| 3,518,830 | A * | 7/1970 | Dunnavant et al. | 60/657 |
| 6,923,000 | B2 * | 8/2005 | Kalina | 60/649 |

FOREIGN PATENT DOCUMENTS

| | | |
|---|---|---|
| DE | 197 36 886 A1 | 3/1999 |
| EP | 0 299 555 A1 | 1/1989 |
| JP | 06042703 A | 2/1994 |
| JP | 07083006 A | 3/1995 |
| WO | WO 97/07323 A1 | 2/1997 |

OTHER PUBLICATIONS

Obriaen Hartford Cogeneration Facility, "The Perfect Match: Combined Cycles and District Heating/Cooling", Power, Apr. 1, 1991, pp. 117-118, 120, XP000209855, ISSN: 0032-5929, No. 4, 862, Hill Pub. Co, New York, NY, US.

* cited by examiner

*Primary Examiner*—Hoang M Nguyen

(57) ABSTRACT

The invention relates to a method for operating a steam power station and a power plant as well as a corresponding steam power station. According to the invention, essentially all of the water that is drained from at least one pressure stage of the steam power station is collected, stored, and recirculated into the water circuit of steam power station.

20 Claims, 1 Drawing Sheet

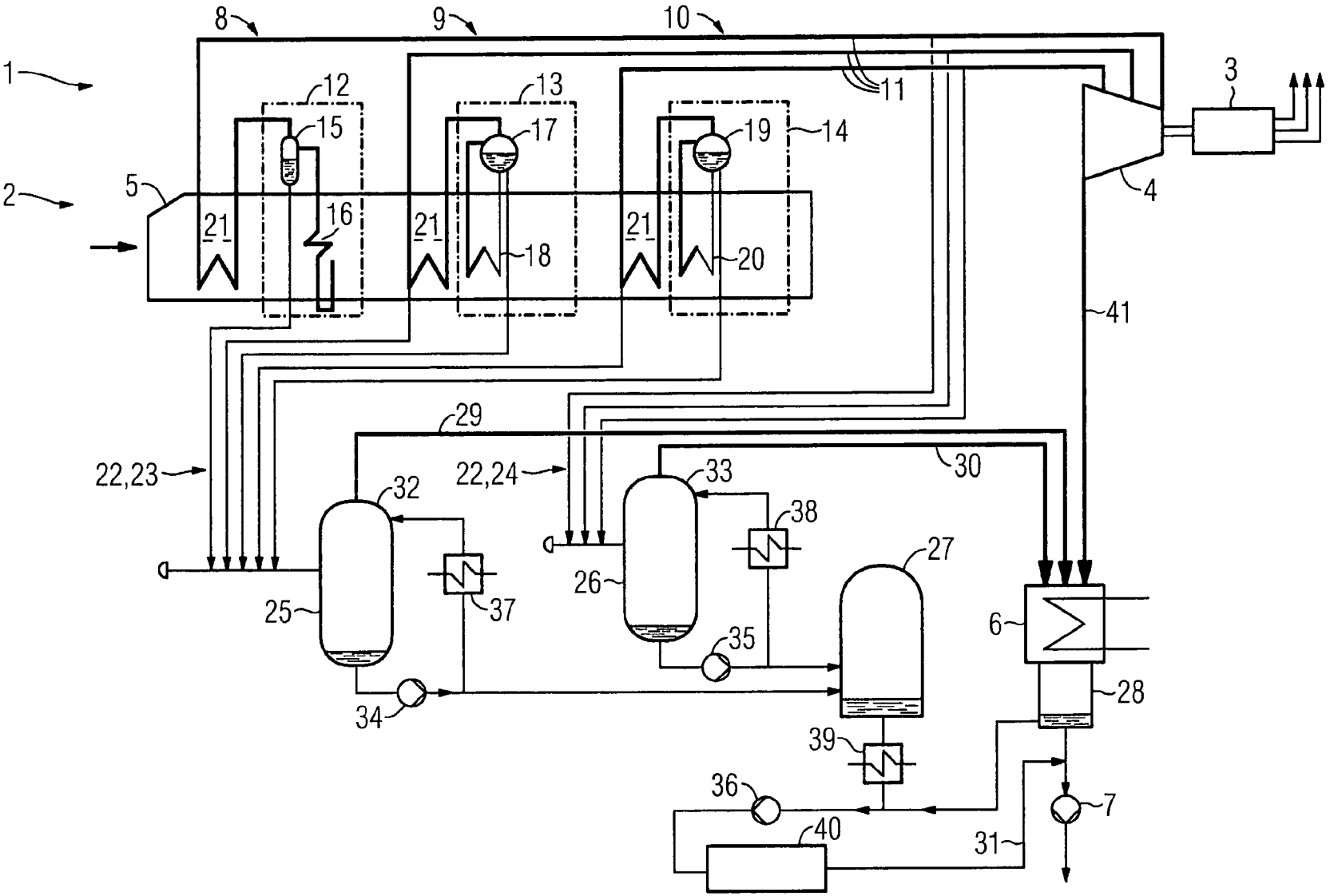
1
2
3
4
5
6
7
8
9
10
11
12
13
14
15
16
17
18
19
20
21
22,23
22,24
25
26
27
28
29
30
31
32
33
34
35
36
37
38
39
40
41

METHOD FOR OPERATING A STEAM POWER PLANT, PARTICULARLY A STEAM POWER PLANT IN A POWER PLANT FOR GENERATING AT LEAST ELECTRICAL ENERGY, AND CORRESPONDING STEAM POWER PLANT

CROSS REFERENCE TO RELATED APPLICATIONS

This application is the US National Stage of International Application No. PCT/EP2005/056008, filed Nov. 16, 2005 and claims the benefit thereof. The International Application claims the benefits of European application No. 04028295.6 filed Nov. 30, 2004, both of the applications are incorporated by reference herein in their entirety.

FIELD OF INVENTION

The present invention relates to a method for operating a steam power plant and in particular a method for operating a power plant for generating at least electrical energy using a steam power plant, said steam power plant having a water circuit with at least one pressure stage and water being drainable if necessary from the water circuit or pressure stages. The power plant has at least one electrical generator which can be driven by the steam power plant. The invention additionally relates to a steam power plant for generating at least electrical energy on which the method according to the invention can be carried out.

BACKGROUND OF THE INVENTION

Such a steam power plant usually contains one or more circulation-type steam generators having pressure drums with associated heating surfaces. The circulation-type steam generators are used to produce steam, particularly in different pressure stages, which can be fed to a steam turbine or rather the relevant pressure stage of the steam turbine. The steam power plant can also have one or more so-called once-through steam generators, also known as Benson boilers which, however, are mostly incorporated in the high-pressure stage.

Conventionally, steam power plants are more or less heavily drained depending on the operating state of the steam power plant. Draining takes place e.g. during ongoing operation from long-closed pipework in which condensate has collected. For this purpose the relevant pipework is briefly opened, thereby draining it. This means that water is lost from the water circuit and must be replenished by supplying additional water known as deionate. Additional draining occurs during startup or shutdown of the steam power plant, as when the steam power plant is shut down, for example, the steam present in the water circuit gradually condenses and the resulting liquid water must not remain in the system sections, particularly the heating surfaces. During shutdown, more water is drained from the water circuit than is replenished, so that finally no more water is replenished.

It is known to collect the drainings, i.e. to combine them. It is also known to store some of these drainings temporarily in a tank. As the drainings, i.e. the drained water, is conventionally discarded to the environment via a pump, the tank serves only to reduce the operating time and frequency of operation of the pump. It is also known to depressurize the drained water in a separator vessel and to separate the water and steam from one another. The separated steam is then discharged into the environment.

The disadvantage with the prior art is in particular that the expensively produced deionate which is drained off is not returned to the water circuit but is discarded to the environment in the form of waste water. With conventional steam power plants, the deionate costs incurred are significantly increased, particularly in the event of frequent startups and shutdowns. Moreover, the environment is considerably impacted by the heavy waste water discharge. The re-supplied deionate has a high oxygen and carbon dioxide content requiring deaeration of the deionate, which means a longer startup time for the steam power plant.

SUMMARY OF INVENTION

The object of the invention is to eliminate the disadvantages of the prior art. Specifically the object of the invention is therefore to reduce significantly the running costs of a steam power plant, and of a power plant for generating electrical energy using such a steam power plant, which result from deionate provision. A further object of the invention is to reduce significantly the environmental impact of waste water and the consumption of water. It is likewise the object of the invention to shorten the startup time of the steam power plant with minimal cost/complexity.

This object is achieved according to the invention with a method having the features set forth in the claims. In respect of apparatus, the object is achieved by a steam power plant having the features set forth in the claims.

The invention has the advantage compared to the prior art that the costs of providing deionate, particularly in the event of frequent startups and shutdowns, are markedly reduced. Using the invention it is additionally possible to operate steam power plants even in regions with a severe water shortage. In addition, the invention enables a large amount of water to be saved and the environment is less impacted by discharged waste water. The startup time of the steam power plant or of the power plant is shortened. In particular, this is achieved by recycling essentially all the drained water, which essentially means, for example, that about 99% of the drained water is fed back into the system.

Advantageous further developments of the invention will emerge from the sub-claims.

In an advantageous embodiment of the invention the drained water is collected, stored and completely fed back to the water circuit at least from the pressure stage with the highest pressure. Thus the largest part of the drained water can be fed back in a simple manner with little expense, as the amount of water flowing in the highest pressure stage constitutes the largest part of the water in the entire water circuit.

In addition to the highest pressure stage, at least one other pressure stage whose pressure level is lower than that of the highest pressure stage can be advantageously included, all the pressure stages also being able to be included in a corresponding embodiment. In this way a larger part or all of the drained water is collected, stored and fed back to the water circuit, thus saving even more water.

In a further advantageous embodiment of the invention, the drained water undergoes liquid water/steam separation, it being possible for the separated steam to be fed to the condenser of the steam power plant, thereby enabling the separated clean steam to be easily cooled and liquefied in the condenser. This largely eliminates the need for special cooling of the stored water. It also provides a simple means of feeding the collected water back into the water circuit.

In another preferred embodiment of the invention, the drained water accumulating during a shutdown process is only ever returned to the water circuit to the extent that the drainable water, i.e. the maximum amount of water that can be drained off, is stored at the end of the shutdown process, i.e. at standstill. In addition, the amount of water thus drained off is then returned to the water circuit at the next startup.

Advantageously, at least some of the drained water is fed back to the water circuit via a water treatment plant. At the same time at least some of the water leaving the condenser can likewise be fed via the water treatment plant, it likewise being possible to mix the two sub-flows before they enter the water treatment plant. Thus, for example, the quality, in particular the degree of contamination, of the water fed to the water treatment plant can be adjusted, thereby easily preventing overloading of the water treatment plant.

BRIEF DESCRIPTION OF THE DRAWINGS

An exemplary embodiment of the invention will now be explained in greater detail with reference to the accompanying schematic drawing, in which;

FIG. 1 shows an exemplary embodiment of an inventive steam power plant with three pressure stages.

Throughout the following description, the same reference numerals will be used for elements that are identical and have the same effect.

DETAILED DESCRIPTION OF INVENTION

FIG. 1 shows a first exemplary embodiment of a steam power plant 2 according to the invention. The steam power plant 2 is an integral part of a power plant 1, which can also be implemented for instance as a combined gas and steam turbine power plant. The steam power plant 2 has a steam turbine 4 with, in this exemplary embodiment, three different pressure areas. In the exemplary embodiment, the steam power plant 2 also has a water circuit essentially comprising the steam turbine 4, a condenser 6, a condensate pump 7 and three pressure stages 8, 9, 10 each assigned to the respective pressure areas of the steam turbine 4. The water circuit additionally comprises a feed water pump (not shown). The pressure stages 8, 9, 10 are connected to the pressure areas of the steam turbine 4 by steam pipes 11. In the exemplary embodiment, the pressure stages 8, 9, 10 are made up of the first pressure stage 8 embodied as a high-pressure stage, the second pressure stage 9 embodied as a medium-pressure stage and the third pressure stage 10 embodied as a low-pressure stage. The first pressure stage 8 of the water circuit has a once-through steam generator 12 comprising a continuous-flow heating surface 16 and a separator vessel 15. The second pressure stage 9 has a first circulation-type steam generator 13 comprising a first pressure drum 17 and a circulation-type heating surface 18 embodied as a circulation-type evaporator. The third pressure stage 10 constructed similarly to the second pressure stage 9 has a second circulation-type steam generator 14 with a second pressure drum 19 and a second circulation-type heating surface 20 embodied as a circulation-type evaporator.

The heating surfaces 16, 18, 20 are disposed in a boiler 5 which can be embodied, e.g. as in the example, as a horizontal waste-heat boiler and is fed by the exhaust gases of a gas turbine (not shown). In the exemplary embodiment, a superheater 21 is disposed downstream of each of the steam generators 12, 13, 14. The output of the respective superheater 21 is connected to the thereto assigned pressure area of the steam turbine 4 via the respective steam pipe 11. Each steam pipe 11 is an integral part of the respective individual pressure stage 8, 9, 10.

During operation of the steam power plant 2 or of the power plant 1, deionized water known as deionate is supplied by the feed water pump (not shown) to the steam generators 12, 13, 14 via piping which is not shown for simplicity's sake. As, in the example shown, different types of steam generators 12, 13,14 can be used which have different requirements in terms of the quality of the deionate supplied, in particular the ph value, the deionate is conditioned accordingly by a corresponding device (not shown) shortly before it enters the relevant steam generator 12, 13, 14. The steam generator 12, 13,14 evaporates the water fed to it. In the once-through steam generator 12 further superheating mostly occurs. The evaporated water is superheated in the following superheater 21 and fed via the steam pipes 11 to the respective pressure area of the steam turbine 4.

The water leaving the high-pressure area of the steam turbine 4 in the form of steam is conventionally fed to the next-lower pressure stage via piping which is not shown for the sake of clarity. In the example, water leaving the high-pressure area of the steam turbine 4 in the form of steam is therefore fed to the second pressure stage 9. Water leaving the medium-pressure area of the steam turbine 4 in the form of steam is fed to the third pressure stage 10, and therefore finally also to the steam turbine's lowest pressure area 10.

The water leaving the low-pressure area of the steam turbine 4 is fed via an exhaust steam pipe 41 to the condenser 6 for cooling and liquefaction. The exhaust steam pipe 41 completes the water circuit of the steam power plant 2 between steam turbine 4 and condenser 6.

The water leaving the condensate pump 7 is mainly fed to the first pressure stage 8 via the feed water pump (not shown). In the exemplary embodiment, the amount of water flowing in the first pressure stage 8 during operation constitutes approx. 75% of the amount of water flowing in all the pressure stages 8, 9, 10, as much more power is converted in it than with the other pressure stages 9, 10.

The energy supplied to the steam turbine 4 in the steam is converted to rotational energy in the steam turbine 4 and thus applied to the associated electrical generator 3.

During operation, particularly also during startup and shutdown, water is intermittently or in some cases continuously drained from the pressure stages 8, 9, 10. For this purpose the drained water is first collected by a collecting apparatus 22 which in the example is embodied by a first pipe bundle 23 and a second pipe bundle 24. For example, water is continuously drained from the pressure drums 17 and 19 during nominal operation of the steam power plant 2. This process is also known as desludging, as circulating operation causes deposits to build up in the pressure drums 17, 18 which must be removed. For example, approx. 0.5 to 1% of the water throughput of the pressure drums 17, 18 must be continuously drained. As there is no such circulation in the once-through steam generator 12 during nominal operation, the separator vessel 15 in the exemplary embodiment does not need to be continuously drained, but mainly during startup and shutdown at the most. The superheaters 21 among other things are also drained, but again mainly during startup and shutdown only. In the exemplary embodiment, water is also drained from the steam pipes 11 and collected by the second pipe bundle 24. Water can also be drained from other areas or sections of the pressure stages 8, 9, 10 that are not shown because of the simplified representation of the exemplary embodiment.

In the exemplary embodiment, the water drained from the pressure stages 8, 9, 10 and collected is then stored. For this purpose a plurality of storage tanks 25, 26, 27 and 28 are provided which can be more or less filled depending on the operating state of the power plant 1. Specifically in the exemplary embodiment the water drained from the pressure drums 17, 19, the water drained from the separator vessel 15 and the water drained from the superheaters 21 is first fed to the first storage tank 25 where it is stored. The first storage tank 25 is made large enough to ensure that it can initially store for a time, and therefore buffer, the very high inflow of drained water during startup or shutdown of the steam power plant 2. The first storage tank 25 also acts as first separating device 32, as the hot drained water evaporates in the first storage tank 25, liquid water being separated from steam and the per se contaminant-free steam being fed via a first feedback pipe 29 to the input of the condenser 6 and the liquid water being stored for the moment in the storage tank 25. Liquid water stored in the first storage tank 25 is pumped if necessary into a third storage tank 27 by means of a first pump 34. By means of a branch disposed downstream of the output of the first pump 34, the pumped amount of water can be partially or completely pumped back into the first storage tank 25 via a first cooler 37 by an appropriate setting of a valve (not shown), thereby providing additional cooling of the water stored in the first storage tank 25. In particular, by using the first cooler 37, the amount of water evaporated can be reduced and the thermal loading of the condenser 6 can be lessened.

In the exemplary embodiment, the water drained from the steam pipes 11 of the pressure stages 8, 9, 10 is drained by the second pipe bundle 24 and stored in the second storage tank 26. Like the first storage tank 25, the second storage tank 26 is also assigned a cooling circuit consisting of a second pump 35 and a second cooler 38. The second storage tank 26 additionally has a second separating device 33 constituted as in the first storage tank 25, the per se clean water vapor again being feedable to the input of the condenser 6 via a second feedback pipe 30. The liquid water stored in the second storage tank 26 can once again be fed to the third storage tank 27 via the second pump 35 if necessary.

In the exemplary embodiment, the liquid water stored in the third storage tank 27 is if necessary fed via a third cooler 39, a third pump 36 and a water treatment plant 40 to the input of the condensate pump 7 via a third feedback pipe 31.

The water treatment plant 40 is connected and disposed in such a way that the entire liquid phase of the drained water is fed into it and conditioned before said liquid phase is fed back into the water circuit of the steam power plant 2. All the water leaving the third storage tank 27 is fed via the water treatment plant 40 where it is conditioned. In the exemplary embodiment, the water treatment plant 40 is disposed in the secondary flow of the water circuit, a sub-flow of the water leaving a fourth storage tank 28 embodied as a condensate collecting tank being feedable to the water treatment plant 40 via the third pump 36. In the exemplary embodiment, the sub-flow can be mixed with the liquid water coming from the third storage tank 27 before it reaches the water treatment plant 40. Particularly during nominal operation of the steam power plant 2, all the water leaving the condenser 6 can be fed via the water treatment plant 40, the water treatment plant 40 then being in the main flow of the water leaving the condenser 6.

In the exemplary embodiment according to the invention, all the water drained over a particular period is collected, stored to a defined extent and then fed into the water circuit. In the exemplary embodiment, the water drained from all the pressure stages 8, 9, 10 is collected, stored and fed back. In other exemplary embodiments (not shown) the water drained from a single, preferably the highest, pressure stage 8 can be collected, stored and fed back in this manner.

During shutdown, i.e. when the steam power plant 2 is being deactivated, drainings increasingly accumulate. This is also the case during startup, as the steam parameters required for nominal operation can only be attained gradually. The water circuit must also be maintained during shutdown, as heat must be removed from the pressure stages 8, 9, 10 by the circulating water. The accumulated amount of water to be drained is at its greatest at the end of the shutdown process. The drained water can also be fed back during the shutdown process, but this takes place in such a way that all the water is stored at the end of the shutdown process. The storage tanks are designed according to their size or capacity. The pumps 34, 35, 36 and 7 are controlled accordingly. Particularly during a restart, in this way only a small amount of new deionate needs to be added to the water circuit, thereby saving water and lessening the environmental impact through reduced waste water discharge.

Particularly advantageous in the exemplary embodiment is the inventive disposition and use of the water treatment plant 40, as a once-through steam generator 12 is used in the highest pressure stage 8. Once-through steam generators 12 pose more stringent requirements in terms of water quality which can usually only be produced and ensured by the water treatment plant 40. The different water quality requirements compared to the circulation-type steam generator 13, 14 relate in particular to the pH value and oxygen content. As the water treatment plant 40 is necessary anyway because of the once-through steam generator 12, it is more advantageous to feed the comparatively small amounts of water drained from the circulation-type steam generator 13, 14 back to the water circuit likewise via the water treatment plant 40 than to discard them. This mainly applies also to the comparatively heavily contaminated quantities of water desludged from the pressure drums 17, 19, or desludged from the separator vessel 15 during startup and shutdown. In order to relieve the water treatment plant 40, however, it is conceivable not to feed the desludgings from the pressure drums 17, 18 of the circulation-type steam generator 13, 14 back into the water circuit. Steam/liquid water separation is nevertheless possible for these desludgings, the then per se clean steam accumulating being able to be fed back to the water circuit, in particular to the input of the condenser 6.

The water treatment plant 40 can have in particular a mechanical cleaner and a cation/anion exchanger. The water treatment plant 40 conditions the water fed to it, particularly in respect of its chemical properties.

The entire water circuit, in particular the collecting apparatus 22, the storage tanks 25, 26, 27, 28 and the feedback pipes 29, 30, 31, are sealed to the atmosphere in order to prevent uncontrolled air input to the drained water.

The features of the exemplary embodiment can be combined together.

The invention claimed is:

1. A method for operating a steam power plant with a water circuit having at least one pressure stage, a steam turbine and a condenser, comprising:

draining water from at least a highest pressure stage and another lower pressure stage of the water circuit and collecting and storing essentially all the drained water;

separating the collected and stored water into liquid and steam;

feeding the separated steam into the condenser; and feeding back essentially all of the collected and stored water to the water circuit.

2. The method as claimed in claim 1, wherein the drained water is stored in at least one storage tank.

3. The method as claimed in claim 2, wherein the drained water stored and collected during shutdown of the steam power plant is only fed back again at startup.

4. The method as claimed in claim 3, wherein at least some of the drained water is fed back to the water circuit via a water treatment plant.

5. The method as claimed in claim 4, wherein at least a sub-flow of the condensed water leaving the condenser is fed via the water treatment plant.

6. The method as claimed in claim 5, wherein the drained water fed back into the water circuit via the water treatment plant is mixed with the sub-flow coming from the condenser before it enters the water treatment plant.

7. The method as claimed in claim 6, wherein the steam turbine is connected to an electric generator that generates electrical energy.

8. A steam power plant, comprising:

a water circuit having at least one water drainable pressure stage, wherein the drainable pressure stage is a highest pressure stage of the circuit;

a steam turbine in communication with the water circuit;

a condenser connected to an outlet of the steam turbine;

a collecting apparatus for collecting water drained from the at least one pressure stage;

a separating device for separating liquid water and steam connected on the steam side to the input of the condenser via at least one feedback pipe; and a storage tank for storing the collected water to be fed back into the water circuit.

9. The steam power plant as claimed in claim 8, wherein the separating device is an integral part of the storage tank.

10. The steam power plant as claimed in claim 9, wherein the storage tank is large enough to ensure that it can store all the drained water accumulating at the end of the shutdown process of the steam power plant.

11. The steam power plant as claimed in claim 10, wherein a water treatment plant chemically treats and conditions the water fed back to the water circuit.

12. The steam power plant as claimed in claim 11, wherein a plurality of storage tanks are utilized for storing the collected water.

13. A steam power plant comprising:

a boiler comprising a highest-pressure steam generator and a lower-pressure steam generator, each steam generator connected by a respective steam supply pipe to a respective pressure area of a steam turbine;

each steam generator connected by a respective drain pipe to a common first storage tank that separates a first drain water from a first drain steam therein;

a condenser that condenses exhaust steam from the steam turbine into a condensate;

a first steam feedback pipe that feeds the first drain steam from the first storage tank to an input of the condenser;

a water treatment plant that chemically treats and conditions the first drain water; and a water return path that combines treated water from the treatment plant and the condensate from the condenser, and returns them to the highest-pressure steam generator.

14. The steam power plant of claim 13, further comprising:

a respective further drain pipe from each steam supply pipe to a common second storage tank that separates a second drain water from a second drain steam therein;

a second steam feedback pipe that feeds the second drain steam from the second storage tank to the input of the condenser;

a first water feedback pipe that feeds the first drain water from the first storage tank to a third storage tank;

a second water feedback pipe that feeds the second drain water from the second storage tank to the third storage tank;

wherein the first and second drain waters and the condensate are returned to the highest-pressure steam generator via the water return path.

15. The steam power plant of claim 14, further comprising:

a first water cooling circuit that flows selected amounts of the first drain water from the first storage tank through a first water cooler and back into the first storage tank.

16. The steam power plant of claim 15, further comprising:

a second water cooling circuit that flows selected amounts of the second drain water from the second storage tank through a second water cooler and back into the second storage tank.

17. The steam power plant of claim 13, further comprising:

a sub-flow circuit that combines at least a portion of the condensate from the condenser with the first drain water prior to the water treatment plant.

18. The steam power plant of claim 17, wherein the water treatment plant comprises a mechanical cleaner and a cation/anion exchanger.

19. The steam power plant of claim 18, wherein the highest-pressure steam generator is a once-through steam generator.

20. The steam power plant of claim 19, wherein the lower-pressure steam generator is a circulation steam generator.

* * * * *